US005133273A

United States Patent [19]

Brocklehurst

[11] Patent Number: 5,133,273

[45] Date of Patent: Jul. 28, 1992

[54] FITTED SHEET HEMMER

[75] Inventor: Charles E. Brocklehurst, Fountain Inn, S.C.

[73] Assignee: Sew Simple Systems, Inc., Fountain City, N.C.

[21] Appl. No.: 762,490

[22] Filed: Sep. 19, 1991

[51] Int. Cl.[5] ..... D05B 35/02; D05B 37/00

[52] U.S. Cl. ..... 112/262.3; 112/10; 112/121.14; 112/130; 112/141; 112/147; 112/304; 112/122

[58] Field of Search ..... 112/10, 262.3, 262.1, 112/122, 129, 130, 121.15, 121.14, 304, 141, 147

[56] References Cited

U.S. PATENT DOCUMENTS

| | | | |
|---|---|---|---|
| 3,160,080 | 12/1964 | Frydryk | 112/262.2 X |
| 3,906,878 | 9/1975 | Burton | 112/141 X |
| 4,648,336 | 3/1987 | Ragnebring | 112/147 |
| 4,685,408 | 8/1987 | Frye | 112/122 X |
| 4,742,788 | 5/1988 | Dugan | 112/10 X |
| 4,754,717 | 7/1988 | Henze et al. | 112/10 |
| 4,773,341 | 9/1988 | Brocklehurst | 112/147 X |
| 4,856,442 | 8/1989 | Brocklehurst | 112/147 |
| 4,856,444 | 8/1989 | Brocklehurst | 112/10 X |

*Primary Examiner*—Werner H. Schroeder
*Assistant Examiner*—Paul C. Lewis
*Attorney, Agent, or Firm*—Hopkins & Thomas

[57] ABSTRACT

Sheet material 30 is taken from a supply 32 and is cut by cutter 36 into segments 35. The segments are moved rapidly parallel to their cut edges into a slower operating first sewing station 40 where elastic bands are sewn to the side edges of the segments. The rapidly moving trailing portion of the segment 35 of sheet material is temporarily accumulated at the accumulation station 39 and progressively fed at a slower rate through the first sewing station 40. The side edges are folded into overlying relationship with respect to the main body portion at folding station 42. Sewing machines 64 and 165 are moved inwardly of the sewing path to simultaneously cut and sew diagonal corners at the trailing and leading edges of the segments, with the sewing machines pivoting so as to face the relative movement of the sheet material, and the removed corners 25 and elastic banding 21 are pulled away from the work product by a vacuum system 186.

19 Claims, 5 Drawing Sheets

FITTED SHEET HEMMER

FIELD OF INVENTION

The invention generally relates to a system of automatically and continuously forming fitted bed sheets of the type that have a rectangular main body portion which covers the top surface of a bed mattress and have a perimeter skirt which extends about the side surfaces of the mattress and inwardly beneath the mattress. More particularly, the invention relates to the steps of advancing segments of sheet material in spaced series along a processing path, folding the side edge portions into overlying relationship with the segment, and then simultaneously cutting and stitching diagonally across the folded corners of the segment to form the corners of the fitted bed sheet.

BACKGROUND OF THE INVENTION

Fitted bedsheets which are applied in form-fitting relationship with respect to a bed mattress usually include a rectangular main body portion that lies flat on the upper surface of a mattress and a perimeter skirt that extends from the edges of the main body portion at an approximately right angle to fit about the sides of the mattress. Elastic bands extend along the edges of the head and foot portions of the skirt of the bedsheet or along the edges of the side portions of the skirt of the bedsheet so as to draw the skirt of the sheet tight about the bed mattress.

My prior U.S. Pat. No. 4,856,444 discloses a system which pays out sheet material, cuts the sheet material into segments, folds opposite side portions of the segments, and then sews diagonally across the four corners of the segments, thereby forming the four corners of the fitted bedsheet. Elastic banding material is sewn along the opposite sides of the segments before the step of folding and sewing are performed so that the fitted sheet will include the elastic banding for the desired form fit about the mattress. Although my prior system has been successful, the system forms a two ply triangular wedge of material at each corner of the fitted sheet which either is sold as part of the fitted sheet, which is undesirable to the customer, or which must be removed with an additional step in the production process, as with a drum cutter that is timed with the movement of the segments of sheet material. The mechanical removal of the wedges of material is a difficult task because the elastic banding previously sewn into the fitted sheet tends to gather the material at the corners of the fitted sheet and controlling the sheet during cutting is difficult.

SUMMARY OF THE INVENTION

Briefly described, the present invention comprises an automated system for continuously forming fitted bed sheets from a supply of sheet material, whereby the sheet material is advanced along its length from a supply to a cutting station and cut so as to form cut segments of the sheet material. The sheet material is then advanced in a processing path parallel to its opposite edges, and as the segments of sheet material are advanced parallel to their opposite edges along the processing path elastic banding in a stretched configuration is sewn to the side edge portions of each segment, and while the elastic banding remains in its stretched configuration the side edge portions are folded into overlying relationship with respect to the main body of the segment of sheet material, thus forming the side skirts of the bedsheet and the four corners are cut away as overedge stitching is formed diagonally across the cut corner portions so as to complete the formation of the fitted bed sheet.

In order that the system work expediently, an infeed conveyor rapidly transfers the previously cut segments of sheet material out of the cutting station toward the first sewing station. When the leading edge of the on-coming segment of sheet material reaches the sewing station, the leading edge begins to travel at the rate of slower operation of the sewing machines in the sewing station, while the on-coming trailing portion of the segment of sheet material continues to move more rapidly. A recess is formed in the work table so as to temporarily accumulate the on-coming rapidly moving trailing portion of the sheet material, so that the trailing portion can be moved out of the cutting station, out of the way of the next-to-be-cut segment of sheet material.

The elastic band material to be applied to the edge portions of the segments of sheet material is fed through sewing heads at each side of the processing path so that the elastic bands are sewn to the cut head and foot edge portions, with the band material spanning the gaps between adjacent segments of sheet material. The elastic band material is maintained in tension by the conveyor system throughout the continuous process so as to avoid bunching of the segments of sheet material.

The infeed conveyor is movable vertically toward and away from the worktable so that when the infeed conveyor is raised away from the work table the leading edge of the supply of sheet material can travel across the processing path between the work table and the infeed conveyor to reach its cut position, whereupon the cut is formed across the supply of sheet material and the conveyor is lowered down into engagement with the segment of sheet material. This enables the infeed conveyor to make positive contact with the cut segment of sheet material as the segment begins its movement along the processing path.

In order to form the skirts of the fitted bedsheet, the central portion of each segment of sheet material is moved through a U-turn and the edge portions at opposite sides of the processing path are each moved through a first right angle turn as the central portion approaches the U-turn and through a second right angle turn as the central portion moves away from the U-turn. This forms the side edge portions of the segments parallel to and in overlying relationship with respect to the central portion of the segments of sheet material, thereby completing the folding over of the side skirts.

The length of the U-turn travelled by the central portion of the segment of sheet material can be changed with respect to the lengths of the two right angle turns followed by the head and foot edge portions so as to adjust the alignment of the leading and trailing edges of the head and foot edge portions with respect to the leading and trailing edges of the main body of the segment of sheet material.

After the folds have been formed in the segments of sheet material, right and left hand corner cut overedge sewing machines each having cutters or "edge trimmers" mounted thereon move into the opposite sides of the processing path and cut off the corners of the segments and simultaneously form overedge or "overcast" stitching in the angled corner portions of the segment of the sheet material, thereby completing the fitted bedsheet. The corner cut sewing machines are moved laterally into and out of the processing path and the corner cut sewing machines are each rotated about a vertical axis so as to face the direction of relative movement of the oncoming segment of sheet material. This means that each corner cut sewing machine is angled at approximately 45° toward the longitudinal centerline of the segment of sheet material as the sewing machine moves toward the centerline and is angled approximately 45° away from the longitudinal centerline as the sewing machine moves away from the centerline.

Thus, it is an object of this invention to provide an improved method and apparatus for continuously and automatically forming fitted bedsheets from a supply of sheet material, whereby the supply of sheet material is cut into segments and the segments are continuously and automatically processed until the final product is formed.

Another object of this invention is to provide an improved system for automatically sewing the corner structures of segments of sheet material after the edge portions have been folded over into overlying relationship with the central portion of the segments of sheet material so as to form fitted bedsheets.

Another object of this invention is to provide an improved fitted sheet hemmer that occupies a small amount of floor space in a mill and which accurately and rapidly forms fitted bedsheets with a minimum of operator attention.

Another object of the invention is to provide a system for automatically and continuously forming fitted bed sheets in which the excess material at the corners of the fitted sheet are expediently removed as the corners structures are sewn.

Another object of the invention is to provide an improved fitted bedsheet that has the excess material usually present and its corners removed.

Other objects features and advantages of this invention will become apparent upon reading the following specifications, when taken in conjunction with the accompanying drawings.

DETAILED DESCRIPTION

Figure 1:
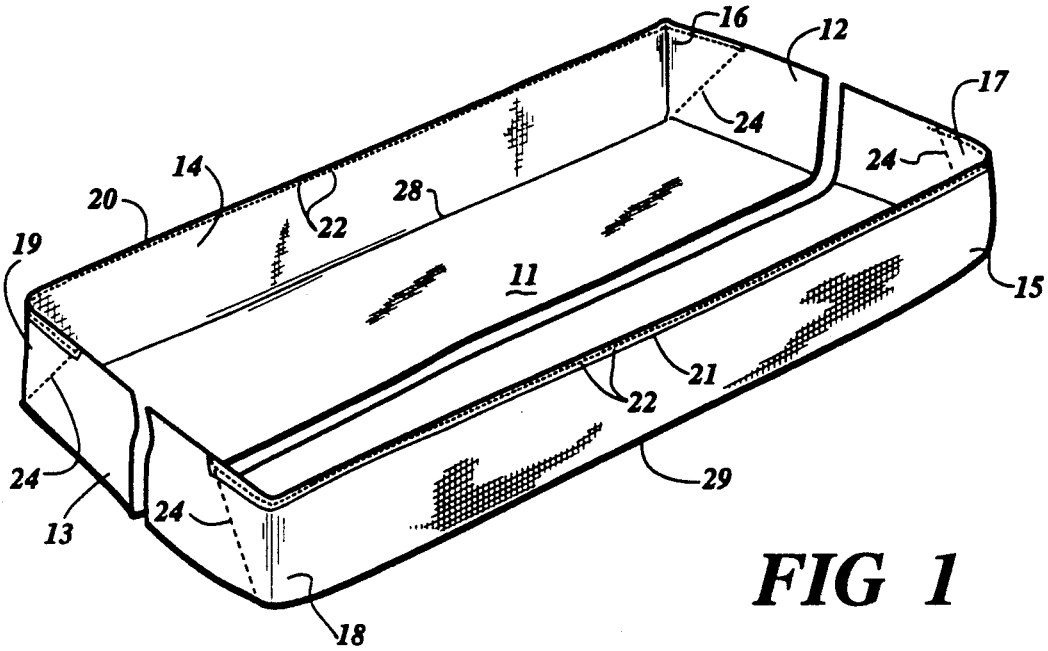
FIG. 1 is an inverted view of a completed fitted bedsheet, with the central portion of the sheet removed to reduce the size of the drawing, and with the elastic banding stretched so as to illustrate the shape of the bedsheet.

Referring now in more detail to the drawings, in which like numerals indicate like parts throughout the several views, FIG. 1 illustrates a fitted bedsheet of a type that is to be mounted in form fitting relationship about a bed mattress. The fitted bedsheet 10 is shown in an inverted position, showing the main body portion 11 that is to cover the upper surface of the mattress, and side skirts 12 and 13 and head and foot skirts 14 and 15. Corner structures 16, 17, 18 and 19 are formed between the respective head, side, foot and side skirts. An elastic band 20 is attached along its length by stitching or similar connection means 22 to the free edge of head skirt 14, and a similar elastic band 21 is attached along its length to the free edge of foot skirt 15.

As best illustrated by corner structure 16, each corner structure is formed by the head or foot skirt 14 or 15 being turned at 90 degrees to begin the formation of the side skirt. The side skirts 12 and 13 are sewn to the head and foot skirts with a diagonal line of overedge stitching 24. The overedge stitching 24 extends over the end portions of the elastic bands 20 and 21 at each corner structure, and anchors the ends of the elastic bands 20 and 21. The stitching 22 formed through the elastic bands anchors the elastic bands adjacent the free edges of the head and foot skirts 14 and 15.

Figure 2:
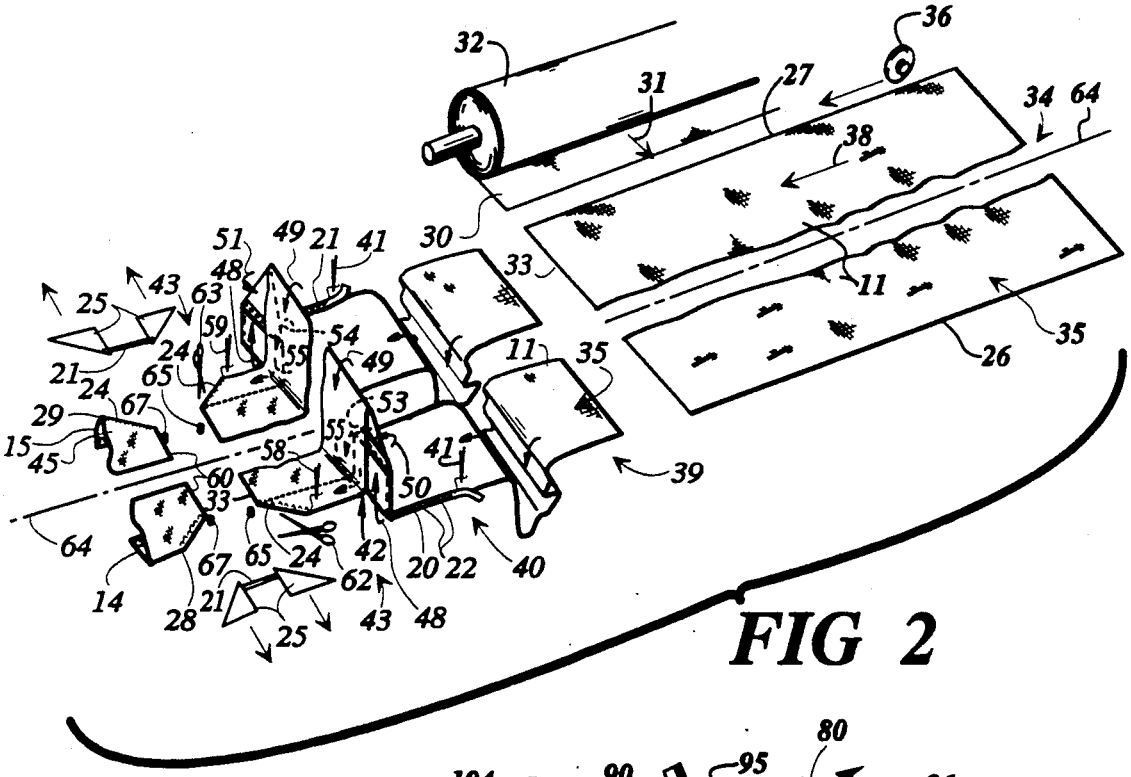
FIG. 2 is a progressive perspective illustration of portions of sequential segments of cut sheet material, showing the steps of attaching elastic banding to the opposite sides of the segments, folding the side portions of the segments into overlying relationship with respect to the main body portion of each segment to form the skirts of the final bedsheet, and then cutting off the corners and sewing an overedge stitching across each of the four diagonal corners of the segment of sheet material to complete the fitted bed sheet.
Figure 3:
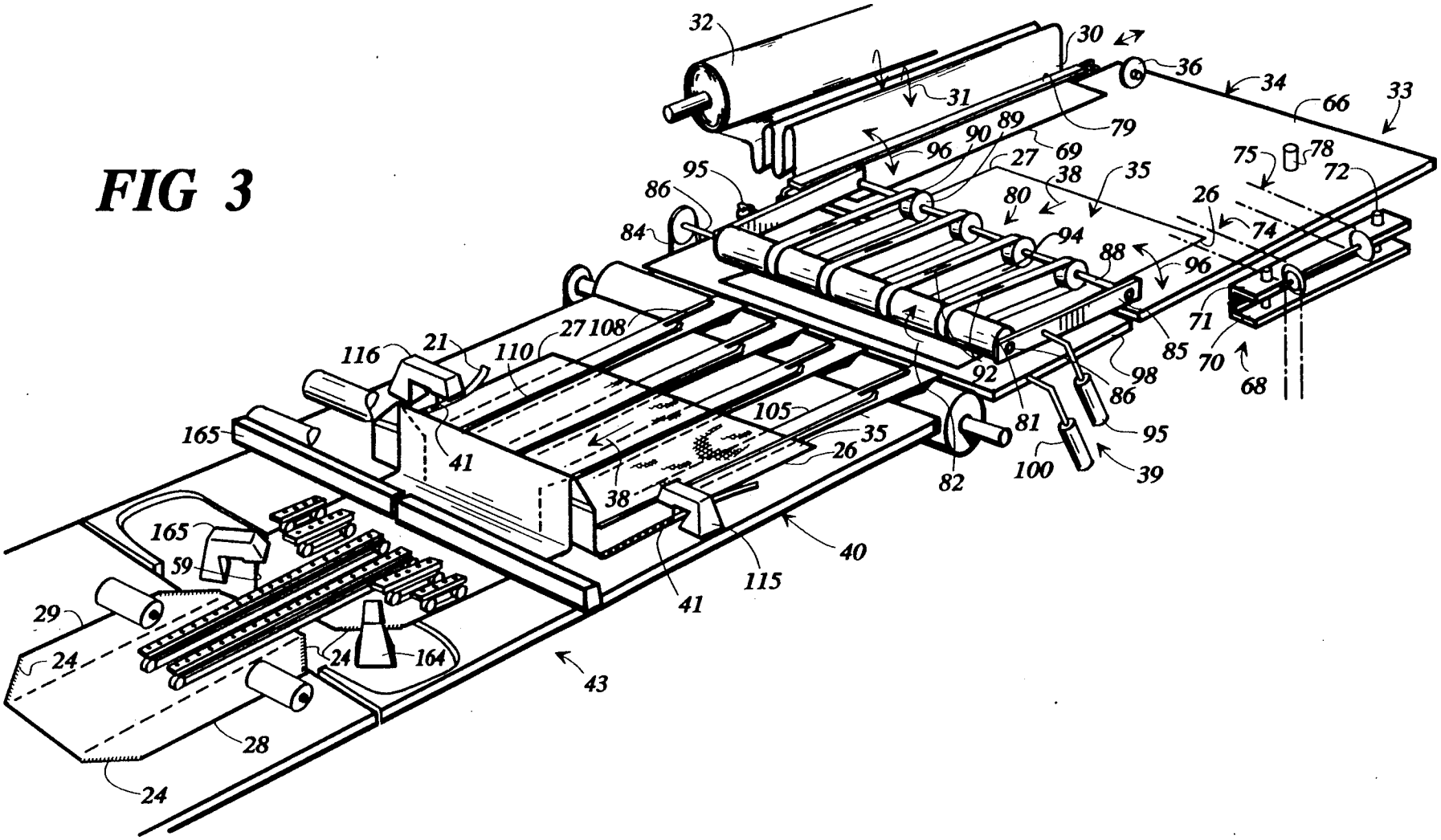
FIG. 3 is a perspective illustration of the fitted sheet hemmer, with the supporting framework and other portions of the apparatus removed for clarity.

As illustrated in FIG. 2, the fitted bedsheet 10 of FIG. 1 is formed by advancing sheet material 30 along its length as indicated by arrow 31 from a supply 32 to a cutting station 34 of a fitted sheet hemmer 33 (FIG. 3). A segment 35 of the sheet material is cut from the supply by a conventional rotary cutter 36 that moves across and cuts through the sheet material. The segment 35 is then moved parallel to its side edges 26 and 27 as indicated by arrow 38 into a temporary sheet accumulation station 39, then through first sewing stations 40 on opposite sides of the processing path where the elastic bands 20 and 21 are sewn by needles 41 of elastic band sewing machines 115 and 116 (FIG. 3) to the side edge portions 26 and 27.

The segment 35 of sheet material continues to advance from the first sewing stations 40 through the folding station 42 and then through the second sewing stations 43 located on opposite sides of the processing path. The side edge portions 26 and 27 each are folded at the folding station 42 into overlying relationship with respect to the main body portion of the segment so as to form the skirts 14 and 15 (FIG. 1) which overlie the next adjacent edge portions 44 and 45 (FIG. 2) of the main body portion 11. As the segment of sheet material moves through the folding station 42 the main body portion 11 as well as the edge portions 26 and 27 move through a 90 degree angle, from a horizontal direction of movement to a vertical direction of movement, as indicated by arrow 48. The main body portion 11 then moves through a 180 degree turn as indicated by arrows 49 so as to begin a downward movement. In the meantime, as the central body portion 11 approaches its U-turn, the edge portions 26 and 27 each progress through a first 90 degree turn 50 and 51 so as to be turned laterally inwardly toward the main body portion 11. As the main body portion moves downwardly away from the U-turn the edge portions each turn through a second 90 degree turn 53 and 54 so as to begin a downward movement with the main body portion 11. This causes the edge portions 26 and 27 to become folded in overlying relationship with respect to the main body portion 11, thereby forming, for example, the head and foot skirts 14 and 15 (FIG. 1).

After the skirts 14 and 15 have been formed, the main body portion 11 and skirts 14 and 15 are turned through a 90 degree turn 55 so as to change directions from downward vertical movement into longitudinal horizontal movement, so that the segment can continue on through the processing path.

As the segment 35 of sheet material moves away from folding station 42 it enters the second sewing stations 43 located at opposite sides of the processing path. The needles 58 and 59 of movable and rotatable sewing machines 164 and 165 (FIG. 3) form the sewn line of overedge stitching 24 at the trailing and leading corners of the folded segment of sheet material. The sewing machines that operate the sewing needles 58 and 59 also include edge cutters 62 and 63 (FIG. 2) which cut as the needles sew, thereby removing the two ply wedges 25 and their connecting segment of elastic banding 20 and 21. The needles 58 and 59 initially are positioned adjacent the folds 28 and 29 of the folded segment of sheet material, and as the trailing edge 60 of a segment 35 is detected by photo cells 65, the needles 58 and 59 and their associated cutters 62 and 63 begin their sewing and cutting functions and the needles and cutters are carried inwardly from the folds 28 and 29.

The combined motion of the needles moving inwardly from the folds 28 and 29 toward the longitudinal centerline 64 of the main body portion 11 and of the movement of the segment of sheet material along the processing path results in the trailing right angle corners 25 being cut from the segments and diagonal corners being formed on the trailing edge of one segment and with the two ply diagonal corners being sewn together at their aligned edges with an overedge stitch. As will be described in more detail hereinafter, the sewing machines will be turned at an angle so that its cutter 62, 63 and the path of its needles face the relative movement of the combined motions of the oncoming sheet material and the lateral movement of the sewing machine.

When the sewing heads have completed their functions at the trailing edge of a segment 35, they will be located inwardly of the opposite sides of the processing path 64 and they will be rotated so as to face diagonally away from the longitudinal centerline 64 of the processing path and will be in the proper position to begin their cutting and sewing functions on the next on-coming segment 35 of sheet material.

Photocells 65 (FIG. 2) initiate the cutting and sewing functions for the next oncoming segment 43 by detecting the edge of the oncoming segment of sheet material. As the cutting and sewing functions of the sewing heads begin, the sewing heads are each moved at a right angle outwardly with respect to the path of movement of the segment of sheet material. Again, the combined motions of the outward movements of the sewing heads together with the movement of the segment of sheet material through the processing path cause diagonal paths of relative movements between the segment and the sewing machines, and because the sewing machines have been turned to face diagonally toward the outer edges of the segment the cutters 62 and 63 and needles 58 and 59 cut and sew diagonally across the corners of the segment at the on-coming edge of the segment.

The elastic bands 20 and 21 are cut by cutters 62 and 63 from between adjacent ones of the segments 35 of sheet material and the cut ends of the elastic bands are sewn to the segment of sheet material by the sewing machines. This completes the construction of the fitted bedsheet.

As illustrated in FIG. 3, the fitted sheet hemmer 33 includes a work table 66 at the cutting station 34. Sheet material puller 68 is mounted above work table 66 and is arranged to travel across the work table and grasp the previously cut leading edge 69 of the sheet material 30 and pull the sheet material rapidly along its length from an accumulation feeder (not shown) into the cutting station 34. The sheet material puller includes a pair of grasping arms 70 and 71 that are movable toward and away from each other by pneumatic cylinders 72. The grasping arms 70 and 71 are suspended from conveyor chain assemblies 74 and 75 which move the grasping arms back and forth across the cutting station 34. The movement of the sheet material puller 68 and its grasping function are controlled by photo cells (not shown) strategically located at positions along the processing path. For example, photo cell 78 determines when the leading cut edge 69 of the supply of sheet material has been pulled the proper distance into the cutting station 34, whereupon the movement of the sheet material puller will be terminated, clamp 79 closed about the sheet and the operation of the rotary cutter 36 will begin so as to cut the segment 35 free from the supply of sheet material.

Figure 4:
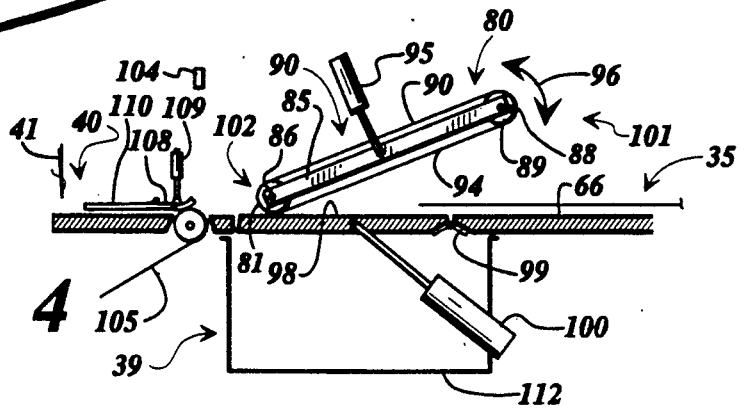
FIGS. 4, 5, and 6 are progressive illustrations of the infeed conveyor of the fitted sheet hemmer.

Infeed conveyor 80 (FIGS. 3 and 4) is located over the processing path and overlaps cutting station 34. Infeed conveyor includes driven roll 81 which is rotated as indicated by arrow 82 by drive system 84. The supporting framework for driven roll 81 is not disclosed. The tilt frame 85 of the infeed conveyor 80 is mounted to the axle 86 at opposite ends of the driven roll 81, and the tilt frame supports moveable axle 88 which extends laterally across the processing path. A plurality of conveyor tape rollers 89 are mounted on the moveable axle 88, and conveyor tapes 90 extend about driven roll 81 and about a conveyor tape roller 89. When the driven roll 81 is rotated as indicated by arrow 82, the conveyor tapes 90 will move, with the upper flights moving as indicated by arrows 92, and with the lower flights 94 moving in the opposite direction.

Fluid actuated cylinders 95 are mounted to the framework (not shown) and tilt frame 85 at opposite sides of the infeed conveyor 80 and function to tilt the infeed conveyor as indicated by arrows 96.

Figure 5:
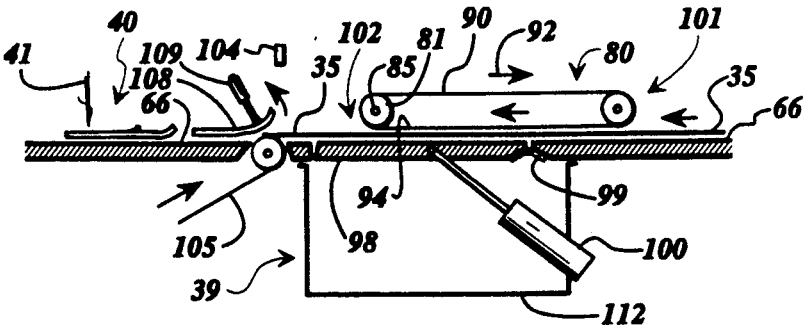
Figure 6:
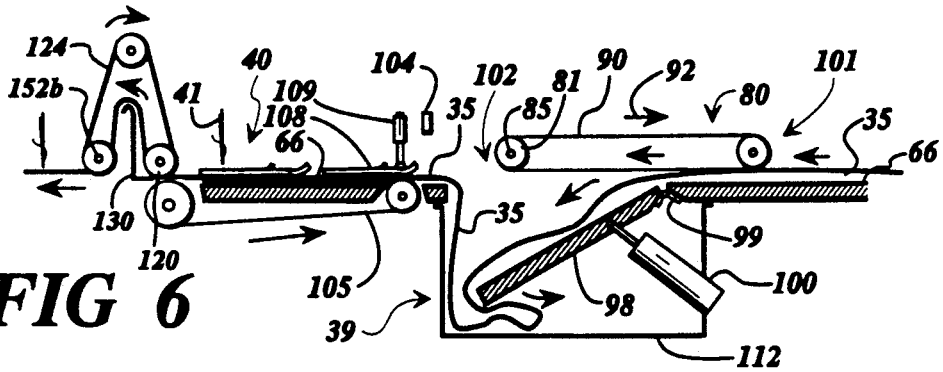

Work table 66 which extends from the cutting station 34 beneath the infeed conveyor 80 includes a moveable section 98 (FIGS. 2–7) that is capable of moving downwardly away from the infeed conveyor 80. As illustrated in FIGS. 5 and 6, the moveable section 98 of the work table is hingedly supported at one end 99 and is movably supported by pneumatic cylinders 100 at opposite sides of the worktable. The cylinders 100 tilt the section 98 of the worktable toward and away from the infeed conveyor 80. It will be noted that the entrance end 101 of the infeed conveyor is positioned over the stationary portion of worktable 66, while the delivery end 102 is positioned over the moveable section 98 of the worktable.

When the sheet material puller 68 (FIG. 3) is to be operated to travel over the worktable 66 and grasp the previously cut edge portion 69 of the sheet material 30 and then pull the sheet material out into the cutting station, the infeed conveyor 80 will be tilted to its up position (FIG. 4) to permit the passage beneath the infeed conveyor of the sheet material puller. When the sheet material puller has reached its home position and is out of the way of the infeed conveyor 80, the infeed conveyor will be tilted downwardly by its cylinders 95 so that its entrance end 101 is urged against the stationary portion of the worktable 66. In the meantime, the delivery end 102 of the infeed conveyor retains its position since the delivery end is mounted at the support axle 86.

When the segment of sheet material has been properly drawn out and cut at cutting station 34 (FIG. 4), the infeed conveyor 80 will be moved from its raised position (FIG. 4) to its lowered position (FIG. 5) and its tapes set in motion by the rotation of driven roll 81. The lower flights of the conveyor tapes 90 engage and move the adjacent side edge portion of the segment 35, thereby pulling the entire segment in a stretched out, flat configuration across the worktable 66, across its moveable section 98 and into the first sewing station 40. The movements of the system are timed by a control system so that when the leading edge of the segment 35 has moved across the moveable section 98 of the work table into the sewing station 40, the cylinders 100 are actuated so as to drop the moveable section 98 of the worktable (FIG. 6). Also, a photo cell 104 (FIG. 5) can detect the presence of the segment, if desired.

In the meantime, the table surface conveyor tapes 105 are driven by tape rolls 106 across the stationary portion of the worktable 66 and the leading edge of the segment of sheet material is advanced on to the conveyor tapes 105. Moveable presser feet 108 are positioned over each conveyor tape 105, and pneumatic cylinders 109 raise and lower the moveable presser feet. When the on-coming edge of the segment of sheet material is detected by the photo cell 104, the cylinders 109 are actuated to move the presser feet 108 downwardly into engagement with the segment 35, pressing the segment into positive relationship with the moving conveyor tapes 105, causing the leading portion of the segment to be positively carried through the first sewing station 40. Stationary presser feet 110 also assist in pressing the segment 35 of sheet material against the conveyor tapes, to make sure that the segment is positively carried on through the first sewing station.

The infeed conveyor 80 operates at a surface velocity that is four or five times faster than the feed velocity of the sewing stations. With this arrangement, the infeed conveyor will rapidly advance the segments 35 of sheet material out of the cutting station 34 so that the cycle of drawing out and cutting an additional segment of sheet material can be accomplished very soon after the previously cut segment has been formed. In the meantime, the previously cut moving segment of sheet material will not be allowed to overrun the sewing station 40 because of the downward movement of the section 98 of the worktable which permits the rapidly moving trailing portion of the segment 35 of sheet material to fall downwardly into an accumulation bin 112 located beneath moveable section 98 at the temporary sheet accumulation station 39.

As illustrated in FIG. 3, the first sewing station 40 includes a pair of elastic band sewing machines 115 and 116 located at opposite sides of the processing path. Sewing machines 115 and 116 operate to attach the elastic bands 20 and 21 to the cut edge portions 26 and 27 of the segment 35 of sheet material. The sewing machines 115 and 116 are, for example, Wilcox and Gibbs overedge machines with an elastic attachment. These are conventional in the art. In one embodiment of the invention the sewing machines 115 and 116 operate continuously during the operation of the fitted sheet hemmer 33, so that the elastic bands 20 and 21 not only are attached to the head and foot edge portions of the segment of sheet material but also extend between adjacent segments. In another embodiment the operation of sewing machines 115 and 116 is intermittent so as to apply the elastic band to the end portion and across the gaps of adjacent segments and to cut the elastic band and terminate the sewing function intermediate the ends of a segment so that the elastic band is not applied along the entire length of a segment. In normal operation it is expected that the gaps between adjacent segments of sheet material will be from four to six inches.

Figure 7:
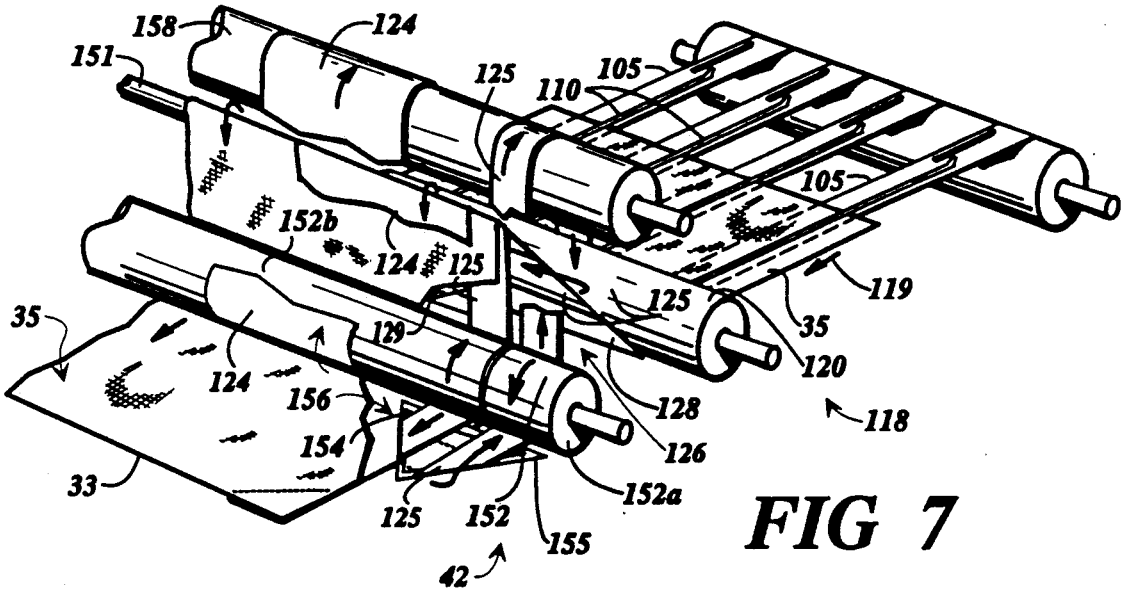
FIG. 7 is a perspective illustration of the folder, with parts broken away to illustrate the movement of the belts and of the segment of sheet material through the folder.
Figure 9:
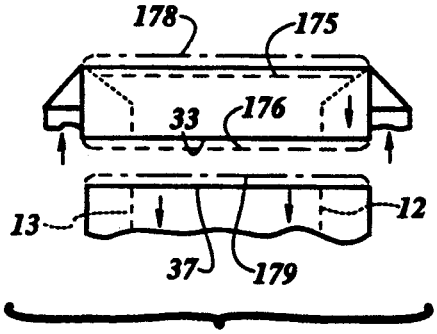
FIG. 9 is a schematic illustration of adjacent segments of sheet material, showing how the adjustments of the length of the U-turn traversed by the central portion of the segments of sheet material changes the alignment of the trailing and leading edges of the central portion and side skirts of the segments.
Figure 8:
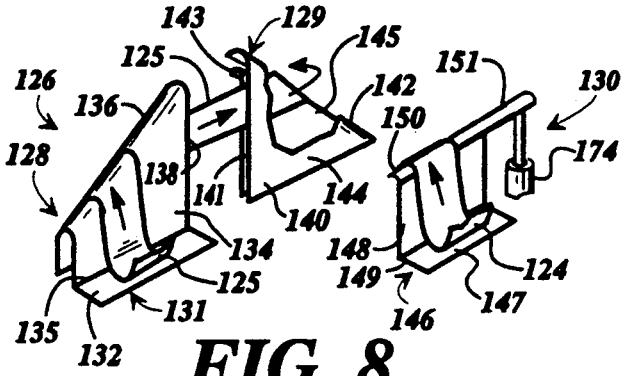
FIG. 8 is an exploded perspective illustration of an end portion of the folder, illustrating how the central feed belt and the side fold belts move through the folder.

FIGS. 7 and 8 illustrate the operation of one-half of the folder apparatus 118 which is positioned in the folding station 42. FIG. 7 illustrates the segment 35 of sheet material advancing in the direction of arrow 119 into the folder apparatus 118. The sheet material is carried by the surface conveyor tapes 105 and the stationary presser feet 110 until the leading edge of the sheet segment is introduced beneath the lower infeed roll 120 of the folder apparatus. Central feed belt 124 and the side folder belts 125 on each side of the central feed belt (only one shown) move downwardly and then about the lower surface of infeed roll 120 and then in an upward direction. The belts 124 and 125 then pass about the fold plate assembly 126. The segment of sheet material is carried in unison with the belts, and the segment as well as the belts are driven in unison with the infeed roll 120.

As illustrated in FIG. 8 fold plate assembly 126 at each side of the folder apparatus 118 includes outer and inner bevel plate assemblies 128 and 129 positioned at the edge of each segment of the sheet material and central fold plate assembly 130 which spans the gap between the bevel plate assemblies 128 and 129 at each side of the folder apparatus.

As previously stated, the outer and inner bevel plate assemblies 128 and 129 are located on opposite sides of the fold plate assembly. FIG. 8 illustrates only one of the pairs of outer and inner bevel plate assemblies. Outer bevel plate assembly 128 includes guide sheet 131 that has a horizontal span 132 and a vertical span 134 that is formed by the bend 135 in the guide sheet. Vertical span 134 includes an upper beveled bend 136 that is oriented at a 45 degree angle with respect to the vertical edge 138 of the guide sheet. The beveled bend 136 is an inverted U-shape and forms a rounded surface on which the side folder belt 125 can move.

Inner bevel plate assembly 129 includes a pair of beveled guide plates 140 and 141 that are of similar shape and which are closely spaced from each other. Each beveled guide plate 140 and 141 include an upper sloped bend 142 and 143 sloped at 45 degrees from vertical, with the bends extending from the vertical span 144 and 145, and with the bend 142 curving over the bend 143.

Central fold plate assembly 130 (FIG. 8) includes a guide sheet 146 that includes a horizontal span 147 and a vertical span 148, with an intermediate 90 degree bend 149. The upper end portion of vertical span 148 terminates in an inverted U-shape bend 150. A span bar 151 extends coextensively with upper bend 150 and extends across the folder apparatus to the other side of the processing path and joins to the guide sheet at the opposite central fold plate assembly.

Side folder belt 125 moves upwardly from infeed roll 120 and moves about the beveled bend 136 of the outer beveled plate assembly 128. Because of the 45 degree angle of the bend 136, the side folder belt 125 turns 90 degrees and begins a lateral movement from the outer bevel plate assembly 128 toward the inner bevel plate assembly 129. The side folder belt 125 enters the space between adjacent beveled guide plates 140 and 141 and then curves about the beveled bend 143 of the beveled guide plate 141. As the side folder belt moves about the beveled bend 143, it makes a 90 degree turn, beginning its downward movement from the inner bevel plate assembly toward the outfeed roll 152.

As illustrated in FIG. 7, when the side folder belt 125 moves about outfeed roll 152, it turns 90 degrees to a horizontal run and moves about the beveled edges 154 and 155 of the triangular shaped turning plate 156. This causes the side folder belt to make a U-turn and move back toward reverse rotating segment **152*a* of outfeed roll 152, turn 90 degrees about the outfeed roll to move upwardly and then through a U-shaped turn about upper return roll 158. The side folder belt then returns in a downward direction to the infeed roll. It will be noted that outfeed roll 152 is formed in segments, with end segments 152*a* rotating in one direction and central segment 152*b*** rotating in the opposite direction, so that the directions of rotation of the outfeed roll are compatible with the movements of the side folder belt.

Central feed belt 124 also moves downwardly and then about infeed roll 120 and picks up the main body portion 11 of the segment 35 of sheet material, moving the segment upwardly and then through a U-turn over the upper bend 150 of the guide sheet 146. The central feed belt then moves downwardly, then around the lower portion of outfeed roll 152 so as to make a U-turn and begin its upward run back over the upper return roll 158 and then back down to the infeed roll 120.

It will be noted from FIG. 7 that the central feed belt 124 causes the main body portion 11 of the segment of sheet material to move through an inverted U-shaped turn. In the meantime, the side folder belts 125 engage and move the edge portions of the segment, which eventually become the head and foot skirts 14 and 15 of the fitted sheet, and carry those portions of the segment first through the 90 degree position with respect to the segment, and then through a second 90 degree turn where the skirts are aligned with the main body portion of the segment 35. It will be noted that the side folder belts 125 are first applied to the top surface of the segment of sheet material and carry the head and foot edge portions into folded relationship with the main body portion 11 of the segment of sheet material, and then emerge from the folder beneath the segment of sheet material and are simply turned at 90 degrees to run out from beneath the segment of sheet material, and then make another 90 degree turn whereupon the return flight is aligned with the entrance flight.

Figure 10:
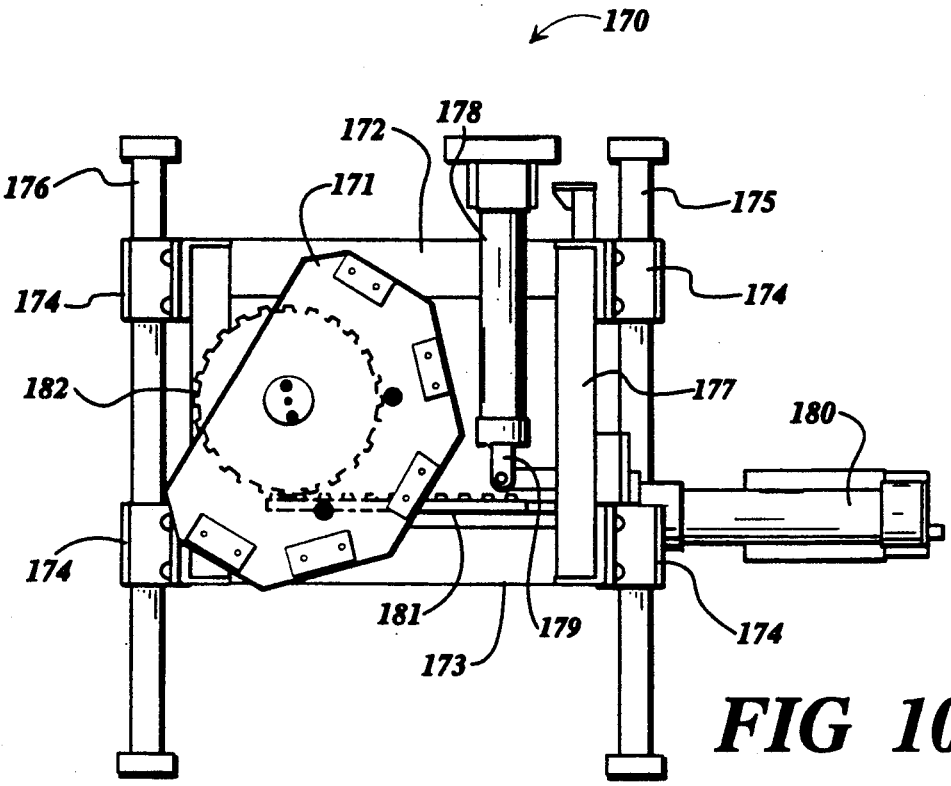
FIG. 10 is a plan view of a sewing machine support system that moves the corner cut sewing machines laterally into and out of the processing path and rotates the sewing machines to face the relative movement of the oncoming segment with respect to the sewing machine.
Figure 11:
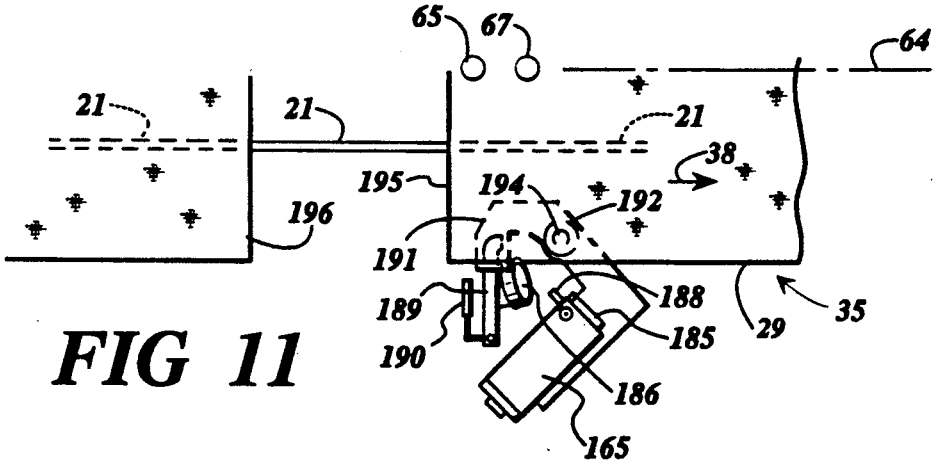
FIGS. 11–16 are progressive illustrations of one of the corner cut sewing machines, showing the movements of the sewing machine as adjacent segments of sheet material move along the processing path.

As illustrated in FIG. 3, moveable overedge sewing machines 164 and 165 are located on opposite sides of the processing path 39, with their sewing needles 58 and 59 and edge cutters 62 and 63 oriented so as to cut and sew the corner structures of the segments of sheet material. FIG. 10 is a plan view of a movable sewing machine support system for one of the movable sewing machines 164 and 165, with a sewing machine (not shown in FIG. 10) being mounted on a support platform 171. Support platforms 171 are rotatably mounted on a pair of frame elements 172 and 173, with frame elements 172 and 173 having at each of their ends slide bearings 174. Bearings 174 are slidably mounted on stationary parallel slide bars 175 and 176. Pneumatic cylinder 178 has its piston rod 179 connected to cross bar 177 which is mounted at its ends to frame elements 172 and 173, so that when the piston rod 179 distends from and retracts into its cylinder, the frame elements 172 and 173 and support platform 171 move along the slide bars 174 and 175. Thus, it can be seen that the moveable sewing machine support system comprises a means for laterally shifting or transferring the sewing machine into the processing path of the sheet material.

A second pneumatic cylinder 180 is carried with the frame elements 172 and 173 and support platform 171. Its piston rod is attached to a rack 181 having teeth which face and mesh with the teeth of gear 182. Gear 182 is connected to the support platform 171 and serves to rotate the support platform in response to the reciprocation of the rack 181. Thus, it can be seen that the moveable sewing machine support system comprises a means for rotatably shifting and laterally transferring the sewing machine so that the sewing machine faces toward the oncoming segment of sheet material. Therefore, the sewing machine mounted on the support platform 181 will be moved laterally into and out of the processing path by pneumatic cylinder 178, and the sewing machine will be rotated about a vertical axis by pneumatic cylinder 180.

As illustrated in FIGS. 11–16, sewing machine 165, which is an overedge stitch sewing machine, and which includes an edge trimmer schematically illustrated at 63 in FIG. 2, also includes a chain cutter 185. The sewing machine set up also includes a vacuum conduit 186 located adjacent the position of the needles 188, a gathering arm 189 and its pneumatic cylinder 190, and a work plate 191 which forms the working surface for the sewing machine set up. These elements are all movable in unison with the sewing machine 165 on the movable sewing machine support system 170 (FIG. 10). Tamper disk 192 is placed over work plate 191 in front of the needle position 188, and a pneumatic cylinder 194 lowers the tamper disk into engagement with the leading edge of the segment of sheet material as the edge of the sheet material approaches the needle position 188, thus assuring that the folded layers of the segment are held in contact with each other and are properly presented to the needles of the sewing machine.

The sewing machine 165 is positioned adjacent the processing path 38 so that the folded edge 29 of the segment of sheet material moves across the work plate 191.

Sewing machine 165 is oriented by its pneumatic cylinder 180 (FIG. 10) so that it faces at approximately a 45° angle with respect to the oncoming sheet material, generally toward the longitudinal axis 64 of the processing path. When the trailing edge of a segment 195 uncovers photocell 65, the control system energizes the sewing machine motor (not shown) and actuates pneumatic cylinder 178 (FIG. 10) to begin the lateral movement of the sewing machine as indicated by arrow 198 (FIG. 12) into the processing path. Thus, it can be seen that the photocells of the second sewing stations 43 function as detecting means for detecting the movement of the sheet material for initiating the sewing and cutting processes.

Because of the movement of the segment of sheet material as indicated by arrow 38 and the movement of the sewing machine as indicated by arrow 198, the relative movement of the segment of sheet material with respect to the sewing machine 165 is at an approximately 45° angle, depending on the speeds of the segment moving along the processing path and the speed of the sewing machine as it moves laterally into the processing path. As the sewing machine moves towards its initial sewing contact with the segment, chain cutter 185 is actuated so as to cut the excess thread chain 200 extending from the sewing needles (FIG. 12).

Figure 12:
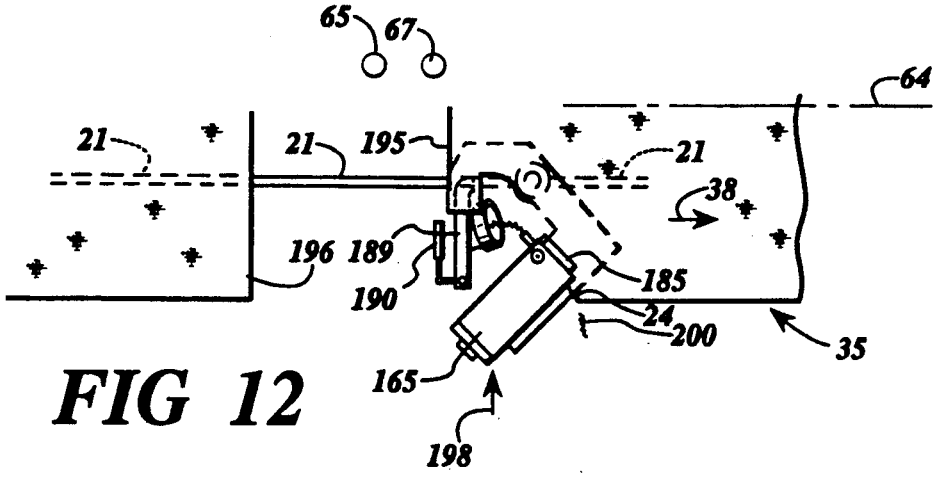
Figure 13:
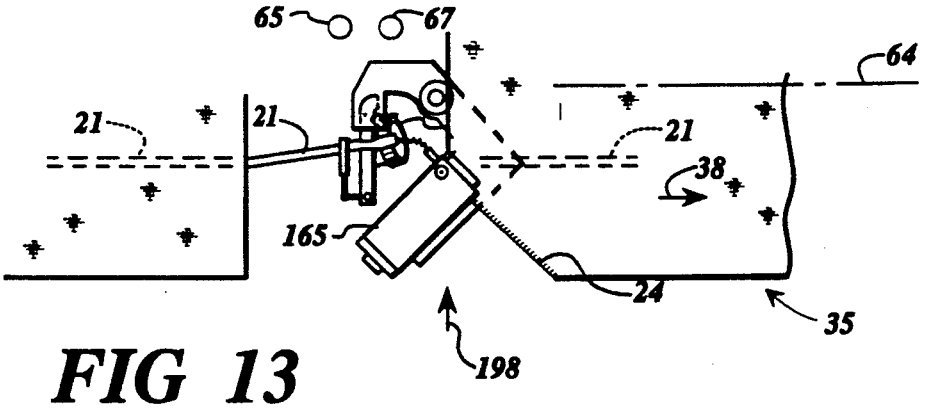

As the sewing machine 165 moves as indicated by arrow 198 further into the processing path, the edge trimmer 63 progressively cuts off the right angle corner of the segment 35, and the now free portion of the corner of the segment is induced to flow into the vacuum conduit 186 (FIG. 12). This progressively removes the two ply triangular corner of the segment. The sewing machine continues its inward lateral movement as indicated by arrow 198 until it reaches the position show in FIG. 13, where both the sewing needles and edge cutter 63 have passed the elastic banding material 21, so that the line of stitching 24 intersects the elastic band 21 in the segment of sheet material and the edge cutter 63 cuts away the elastic banding material spanning the space between the adjacent segment 35 of sheet material. However, the cut away span of elastic banding material remains attached to the now cut away two ply triangular corner of the segment which has been progressively moved into the vacuum conduit 186 (FIGS. 2 and 13).

Figure 14:
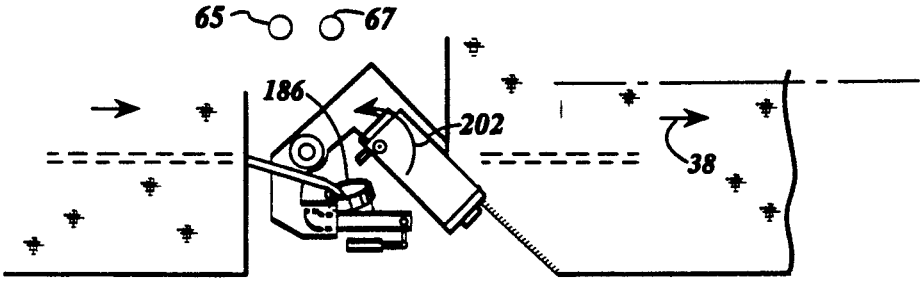

Once the sewing machine has completed the formation of the overedge stitching 24 to form the diagonal edge in the trailing edge of the segment of sheet material (FIG. 14), the chain cutter 185 is actuated again so as to cut the chain of thread extending from the needles of the sewing machine back to the just previously sewn segment 35, and the sewing machine is rotated about a vertical axis as indicated by arrow 202 of FIG. 14. The center of rotation of the sewing machine is within one inch of the needle position of the sewing machine, so that the needles 59 of the sewing machine and the edge cutter 63 of the sewing machine will be in a good position to begin the cutting and sewing of the oncoming segment of sheet material.

Figure 15:
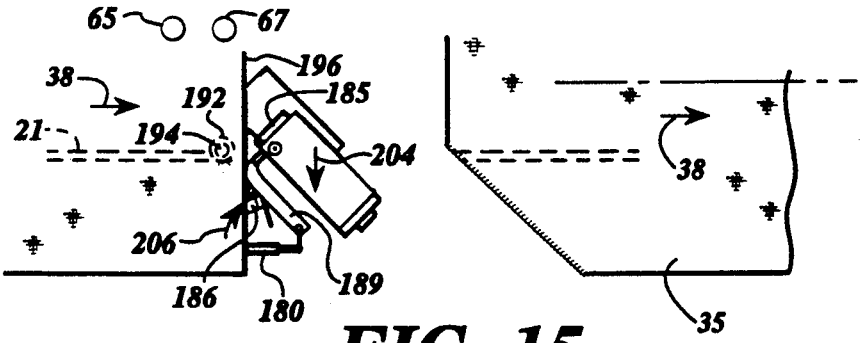
Figure 16:
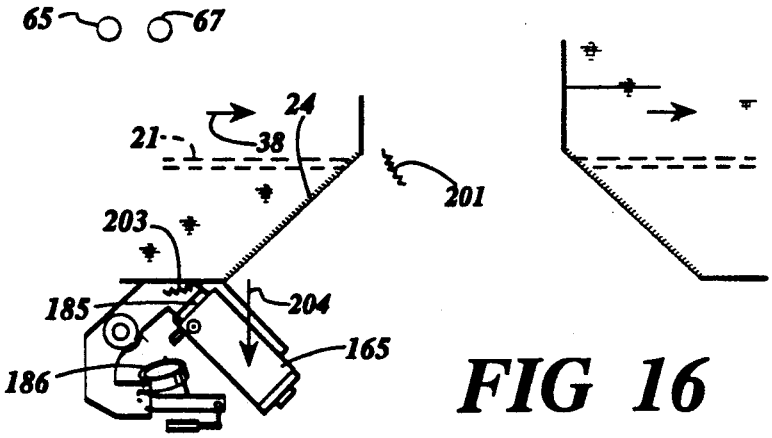

As illustrated in FIG. 15, when the oncoming edge 196 moves over photocell 67, the control system begins the outward lateral movement of the sewing machine 165, as indicated by arrow 204. Again, the lateral movement of the sewing machine 204 combined with the longitudinal movement 38 of the segment of sheet material results in the relative movement of the sheet material with respect to the sewing machine being at an approximately 45° angle, so that the sewing machine cuts and sews diagonally across the right angle corner as indicated in FIG. 16. The sewing machine will have been turned so that it faces the relative movement of the segment with respect to the sewing machine. Just as the sewing machine starts its outward lateral movement as indicated by arrow 204 (FIG. 15), the chain cutter 185 is again actuated to trim any excess thread chain 201 away from the segment of sheet material. Likewise, when the sewing machine 165 moves off the segment (FIG. 16), the chain cutter 185 is again actuated to trim the thread chain 203.

As the sewing machine 165 begins its outward lateral movement as indicated by arrow 204 in FIG. 15, the elastic band gathering arm 189 is pivoted as indicated by arrow 206 by its cylinder 190, so that the teeth at the distal end of the gathering arm engage the elastic band 21, positively pulling the elastic band and the right angle corner of the oncoming segment of sheet material toward the needle position of the sewing machine. Simultaneously, the tamper disk 192 is lowered by its cylinder 194 so as to press the oncoming two ply edge of the segment of sheet material to a flat configuration so as to be properly received at the presser foot and feed system of the sewing machine. In the meantime, the elastic band 21 will have been pulled by the airstream entering vacuum conduit 186, to assure that positive control is maintained over the oncoming segment of sheet material as it moves with the sewing machine. This is important because the elastic banding material tends to gather the sheet material when the sheet material and the band are released. The combination of the vacuum conduit 186 and the gathering arm 189 prevent any significant gathering of the oncoming segment of sheet material until the feed system and presser foot of the sewing machine take control of the segment. Further, as the sewing machine cuts and sews its diagonal line of overedge stitching 24 across the oncoming segment of sheet material, the vacuum conduit continues to pull the progressively cut away the wedge of material, thereby retaining control over the segment of sheet material.

It will be noted that the lines of overedge stitching 24 extend across the elastic banding 21. This firmly anchors the banding material to the now completed segment of sheet material. Further, the segment of banding material which is removed from between the adjacent segments of sheet material positively joins the removed right angle corners, so that the vacuum conduit 186 effectively and conveniently removes both corners as well as the cut-away strip of banding material from the vicinity of the cutting and sewing process.

Although a preferred embodiment of the invention has been described, various modifications, additions and deletions may be made thereto without departing from the spirit and scope of the invention as set forth in the following claims.

I claim:

1. A continuous method of producing fitted sheets for mattresses whereby the sheets include a main body portion for placement on the top surface of a mattress and side skirts that fit about the sides of the mattress comprising:

advancing segments of sheet material in series along a processing path parallel to opposite edges of the segments, as each segment is advanced parallel to its opposite edges, applying an elastic banding to said opposite edges of the segment, folding the opposite edges and the elastic banding with respect to the main body of the segment to form side folds at opposite sides of the segment, cutting the corners off the trailing and leading edges of the side folds of the segments to form diagonal folded corners while simultaneously forming overedge stitching across the diagonal folded corners adjacent the trailing and leading edges of the segments and removing the trailing and leading cut off corners from the segments as the steps of cutting and stitching are performed.

2. The method of claim 1 and wherein the step of simultaneously cutting and forming an overedge stitch across the diagonal folded corners comprises moving sewing machines each with an edge trimmer at a right angle with respect to the advancement of the segment of sheet material with the sew direction of the sewing machine oriented at an angle across the corner of the segment.

3. The method of claim 2 and wherein the step of moving a sewing machine with an edge trimmer at a right angle with respect to the advancement of the segment of sheet material comprises moving a sewing machine from a position adjacent a side fold and sewing onto the side fold and sewing off the trailing edge, turning the sewing machine approximately 90°, and sewing onto the leading edge of the next adjacent segment and sewing off the side fold.

4. The method of claim 1 and wherein the step of simultaneously cutting off the corners and forming an overedge stitch across the folded edges at the trailing and leading corners of the segments comprises cutting and forming an overedge stitch across the elastic banding.

5. The method of claim 1 and wherein the step of applying the elastic banding to the opposite edges of the segments comprises extending the elastic banding between adjacent segments of sheet material to attach the corners of adjacent segments together, and wherein the step of cutting off the corners of the trailing and leading edges of the side folds of the segments comprises cutting across the elastic banding at the trailing and leading edges of the segments to separate the segments of sheet material, and further including the step of progressively moving with an air stream the cut off corners and the elastic banding extending between the attached cut off corners to a waste area as the corners are cut from the segments of sheet material.

6. The method of claim 1 and wherein the steps of cutting the corners off the trailing and leading edges of the segment while simultaneously forming over edge stitching across the folded edges of the segments adjacent the trailing and leading corners of the segments comprises moving at opposite sides of the processing path sewing machines each with an edge trimmer at approximately right angles with respect to the direction of movement of the segment along the processing path into and out of the processing path and across the fold, turning each sewing machine at angles which cut and sew across the folded portion of the segment along the path of relative movement of the segment and the sewing machine.

7. The method of claim 1 and prior to the step of advancing segments of sheet material in series along a processing path further including the steps of advancing sheet material along its length from a supply, cutting across the length of the sheet material to form the sheet material into segments.

8. A fitted bedsheet formed by the method of claim 1.

9. A method of producing fitted sheets for mattresses whereby the sheets include a main body portion for placement on the top surface of a mattress and side skirts that fit about the sides of the mattress, comprising:

advancing segments of sheet material in sequence parallel to their side edges along a processing path, as the segments move along the path, folding the side edges with respect to the main body portion of each segment to form the skirt of the sheet, simultaneously cutting off the leading and trailing corners of the skirts and forming a stitch at the cut edge of the segment.

10. The method of claim 9 and wherein the step of simultaneously cutting off the leading and trailing corners of the skirts comprises:

moving a sewing machine with an edge cutter into and out of the processing path across the folded side edges of the segment of sheet material at the leading and trailing corners of the skirts, and turning the sewing machines to face the path of relative movement of the segment of sheet material with respect to the sewing machine.

11. A fitted bedsheet formed by the method of claim 9.

12. A continuous method of forming fitted bed sheets and the like with a main body portion for placement on the top surface of a mattress and side skirts at the perimeter of the main body portion for fitting about the sides of the mattress, comprising:

advancing segments of sheet material in spaced series parallel to their opposite edges along a processing path, and as the segments are advanced in series;

folding the side edges of each segment into overlying relationship with adjacent portions of the main body portion of the segment to form skirts at opposite side edges of the segment, moving a sewing machine with an edge cutter at opposite sides of the processing path into and out of the processing path as the trailing and leading ends of each segment move past the sewing machine, turning the sewing machines to face the relative movement of the sheet material with respect to the sewing machines as the sewing machines move into and out of the processing path, as the sewing machines move into and out of the processing path cutting off the corners of the trailing and leading edges of adjacent segments and simultaneously sewing across the folded overlying portions of the adjacent segments with the sewing machine and its cutter.

13. The method of claim 12 and further including the step of attaching elastic banding to the side edges of the segments with the elastic banding spanning the space between adjacent segments of sheet material prior to the step of folding the side edges of each segment into overlying relationship with adjacent portions of the main body portion of the segment, and wherein the step of cutting off the corners and sewing across the folded overlying portions includes cutting across the elastic banding to remove the span of elastic banding extending between adjacent segments and sewing the cut ends of the elastic banding to the folded overlying portions.

14. Apparatus for forming fitted sheets of the type having a main body portion for placement on the top surface of a mattress and side skirts about the perimeter of the main body portion for extending about the sides of the mattress comprising:

means for advancing a segment of sheet material parallel to its side edges along a processing path, sewing means at opposite sides of the processing path for attaching elastic banding to opposite edges of the segments as the segments are advanced along the processing path, folding means for folding the opposite edges of the segment and the elastic banding over the body of the segment, sewing and cutting means at opposite sides of the processing path simultaneously for sewing and cutting across the leading and trailing corners of each segment.

15. The apparatus of claim 14 and wherein said sewing and cutting means comprises a pair of sewing machines each having sewing needle means and a trimmer for simultaneously sewing and cutting the segment of sheet material.

16. The apparatus of claim 15 and wherein said sewing and cutting means includes lateral shifting means for moving each sewing machine at a right angle with respect to the direction of movement of the segment along the processing path, and rotary shifting means for turning each sewing machine at angles which face generally toward the oncoming segment and across the fold and into the segment when the sewing machines are being moved toward the segment and generally toward the oncoming segment and across the fold and away from the segment when the sewing machines are being moved away from the segment.

17. The apparatus of claim 15 and wherein said sewing and cutting means includes lateral shifting means for moving each sewing machine across the folded edge of the segment, and rotary shifting means for turning each sewing machine so that the sewing machines sew and cut the segment along the paths of relative movement between the segment and the sewing machine.

18. Apparatus for forming fitted bedsheets and the like with a main body portion for placement on the top surface of a mattress and side skirts at the perimeter of the main body portion for fitting about the sides of the mattress, comprising:

conveyor means for continuously advancing segments of sheet material parallel to their side edges along a processing path in spaced series, folder means in said processing path for folding over the opposite side edges of each segment into overlying relationship with adjacent portions of the main body portion of the segment of sheet material to form skirts at opposite sides of the segment, a sewing machine with an edge cutter positioned at each side of the processing path, lateral transfer means for moving said sewing machines laterally into and out of the processing path, rotary transfer means for rotating said sewing machines into facing relationship with respect to the relative movement of the segments of sheet material as the segments of sheet material are advanced by said conveyor means and as said sewing machines are moved by said lateral transfer means into and out of the processing path.

19. The apparatus of claim 18 and further including:

first detecting means for detecting the movement of the trailing edge of a segment of sheet material past a first predetermined position along the processing path for initiating the movement of the sewing machine into the processing path, second detecting means for detecting the movement of the leading edge of the next adjacent segment of sheet material past a second predetermined position along the processing path for initiating the movement of the sewing machine out of the processing path.

* * * * *